United States Patent [19]

Perches

[11] 4,409,701

[45] Oct. 18, 1983

[54] TOOTHBRUSH

[76] Inventor: Robert Perches, 6124 Santa Monica Blvd., Los Angeles, Calif. 90038

[21] Appl. No.: 405,589

[22] Filed: Aug. 5, 1982

[51] Int. Cl.[3] ..... A46B 9/04

[52] U.S. Cl. ..... 15/167 R; 15/106; 15/172

[58] Field of Search ..... 15/167 R, 167 A, 106, 15/201, 110, 111, 114, 172, 169

[56] References Cited

U.S. PATENT DOCUMENTS

| | | | |
|---|---|---|---|
| 726,716 | 4/1903 | Maher . | |
| 1,592,207 | 9/1926 | Havrilla . | |
| 2,326,632 | 8/1943 | Friedman . | |
| 2,429,437 | 10/1947 | Walker | 15/172 |
| 2,435,394 | 2/1948 | Hawley | 15/201 |
| 2,864,111 | 12/1958 | Rotceig . | |
| 3,680,169 | 8/1972 | Thompson | 15/167 R |
| 4,128,911 | 12/1978 | Perez | 15/167 R |

*Primary Examiner*—Peter Feldman

*Attorney, Agent, or Firm*—Erik M. Arnhem

[57] ABSTRACT

A toothbrush, comprising a head, its top surface provided with exterior rows of bristles and an intermediate slot, leading into a hollow space in the head; a member having its lower portion accommodated in the hollow head space, its upper portion projecting through the slotted head surface and crested by a single row of bristles; a handle extending from the head having a longitudinal groove extending into the hollow head space; a pusher, disposed movably in the groove, which, when pushed forwardly into the hollow head space or retracted therefrom is capable of raising, respectively releasing the member and its row of bristles.

7 Claims, 5 Drawing Figures

TOOTHBRUSH

BACKGROUND OF THE INVENTION (1) Field of the Invention

My invention refers to a toothbrush, especially constructed to improve dental hygiene when brushing teeth. More particularly, the invented toothbrush may be used as the conventional type toothbrush with several rows of bristles, or converted for use as a single bristle row brush.

It is well known that dentists frequently recommend the use of two toothbrushes, as the regular multirow bristled brush cannot reach into the narrow spaces or crevices between teeth; this is particularly true of the molar teeth, which require diligent care because of their food grinding functions; the molars are not as accessible as e.g., the incissors or canines and, also often provoke a gagging sensation in a person trying to reach the molars with a multirow bristled toothbrush.

An added advantage of having dual levels of bristles is that the user may simultaneously and effectively clean out crevices in and between teeth by applying the single bristled row, and the more accessible portions of the teeth by the lower levelled rows of bristles respectively.

Thus, there appears to be a definite need for a toothbrush, as invented, which can be applied interchangeably as a one or multiple row bristled brush, or as a combination thereof.

(2) Prior Art

The following patents, constituting the most pertinent prior art in light of my disclosure, are listed below.

Havrilla, U.S. Pat. No. 1,592,207, 1926
Maher, U.S. Pat. No. 726,716, 1903
Friedman, U.S. Pat. No. 2,326,632, 1941
Rotceig, U.S. Pat. No. 2,864,111, 1958.

U.S. Pat. No. 1,592,207 depicts a toothbrush wherein some of the bristles may be variously adjusted to alter their length. The effective length of bristles 16 may be changed, i.e., their roots are bent, by sliding auxiliary back 15 as will be evident from an inspection of FIGS. 1 and 4.

U.S. Pat. No. 726,716 discloses a toothbrush which may be cleaned by laterally moving one section with respect to the other sections.

U.S. Pat. No. 2,326,632 illustrates an interchangeable toothbrush and is provided of interest with respect to stem 13 and head 20.

U.S. Pat. No. 2,864,111 relates to toothbrushes "comprising a holder or handle portion having a longitudinal groove therein and a resiliently flexible strip or rod slidable in said groove."

SUMMARY OF THE INVENTION

In addition to what was stated above, my invention relates to a toothbrush, its head being, preferably bristled with two (or more) exterior opposite rows and one intermediate one. The ends of the exterior rows of bristles are fixedly embedded in the head of the toothbrush. The intermediate row of bristles crests a member, the lower portion of which is accommodated movably within a bottomed hollow space in the toothbrush head, its upper portion being projected through a slot extending adjacent or between the exterior rows of bristles in the toothbrush head.

When the member rests of the bottom of the hollow space in the brush head, its single row of bristles will lie at the same level as the flanking rows of fixed bristles, constituting, for all practical purposes a conventional toothbrush.

When the member is raised within the hollow space, its bristled crest will be elevated above the fixed rows of bristles, thereby converting the regular type toothbrush into a single row bristled brush. This is accomplished, as will be explained in detail hereinafter, by simple means, not necessitating any metal parts, such as springs, or other potentially injurious components; the actual conversion, as it were, of the toothbrush is carried out with minimal efforts, and will soon become an automatic adjustment by the user, whenever required during the daily brushing of teeth.

The raising of the intermediate bristle row is brought about, simply by causing a narrow pusher - accommodated slideably within a portion of the toothbrush handle substantially in alignment with the base of the movable intermediate bristled member - to slide underneath the base, pushing the intermediate member upwardly through the slotted brush head and thereby elevating the former to project above the top of the fixed bristles. When retracting the member, the intermediate bristles will gravitate to its previous position in alignment with the exterior bristles.

Thus, it is an object of the invention to provide a toothbrush usable as a multiple and/or single row bristled toothbrush.

It is another object of the invention to provide a toothbrush, capable of carrying out the above stated object without containing any potentially injurious parts.

It is a further object of the invention to provide a toothbrush, which may be converted from a multiple to a single row bristled toothbrush, and vice versa, by minimal efforts of its user.

It is still a further object of the invention to provide a toothbrush, which incorporates the features, according to the invention, at a cost practically competitive with conventional type toothbrushes.

DESCRIPTION OF THE INVENTION

Figure 1:
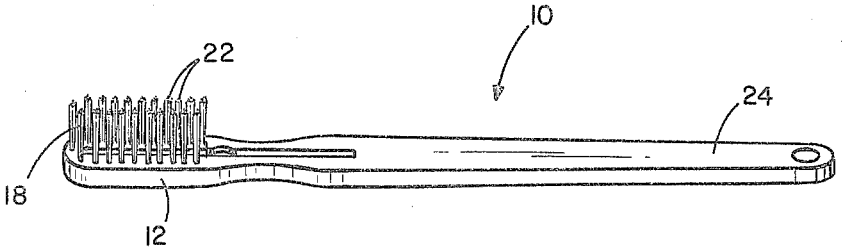
FIG. 1 is a perspective side view of a toothbrush according to the invention, showing a raised intermediate row of bristles.
Figure 2:
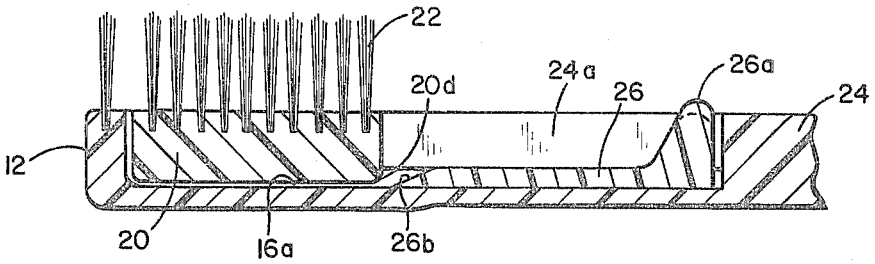
FIG. 2 is a sectional side view of the toothbrush, showing the intermediate row of bristles when at equal height with exterior rows of bristles, the latter having been partially removed for the sake of clarity.
Figure 4:
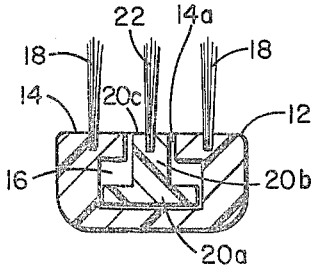
FIG. 4 is a transverse section of the head of the toothbrush, showing all bristled rows at equal level.

In the drawings like reference characters designate similar parts in the several views of the drawings. In FIG. 1, numeral 10 indicates the toothbrush, according to the invention, in its entirety. The head 12 of toothbrush 10 has a top surface 14, provided with a, preferably centered slot **14*a*, which leads into a bottomed hollow space 16. (e.g., FIG. 2 or FIG. 4), preferably in the shape of an inverted "T". Rows of first bristles 18 are fixedly embedded in the top surface 14 of head 12, flanking intermediate slot 14***a*. A member 20, substantially in the shape of an inverted "T" is accommodated loosely, and movably within space 16. Member 20 consists, preferably of a horizontal base 20*a* and a vertical stem 20*b*, extending vertically upward therefrom, thus basically conforming to the shape of hollow space 16. Base 20*a* of member 20, when inactive, is resting on the interior bottom 16*a* of hollow space 16, with its stem 20*b*, (e.g. FIG. 4) protruding through slot 14*a* of head 12. The top 20*c* of member 20 is crested by a row of second bristles 22 projecting above head 12, at equal level with first bristle rows 18 (in FIG. 2).

Figure 3:
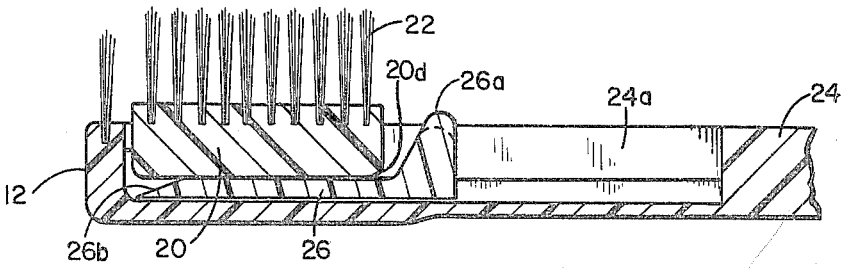
FIG. 3 is a sectional side view of the toothbrush, as shown in FIG. 2, with the intermediate row of bristles having been raised above the level of flanking rows of fixed bristles (not shown).
Figure 5:
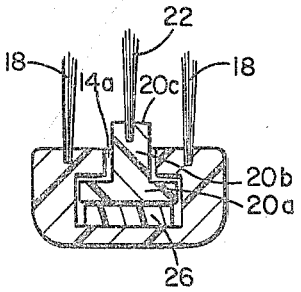
FIG. 5 is a transverse section of the head of the toothbrush, showing the raised intermediate row of bristles relative to flanking bristles.

The handle 24 of toothbrush 10 is provided with a longitudinal grooved portion 24*a*, preferably disposed in the top surface of handle 24. Groove 24*a* extends into hollow space 16 (FIG. 2) and a pusher 26 is accommodated movably within groove 24*a*, capable of being pushed through groove 24*a* into space 16 and more precisely underneath the entire bottom surface of base 20*a* of member 20 (FIG. 3). When pusher 26 is so moved forwardly, member 20 will be raised upwardly by a distance equal to the height of pusher 26 and second bristle row 22 will then project above the fixed rows of first bristles 18; the toothbrush can, thus be used as a single bristle row toothbrush. When pusher 26 is retracted member 20 will automatically gravitate to the bottom of hollow space 16 (FIG. 5) and the second bristle row 22 revert to the level of the first bristle rows. The clearance around based 20*a* and stem 20*b* of member 20 is dimensioned to allow portions of member 20 to be snugly raised within space 16 and through slot 14*a*, respectively to accomplish the object of my invention. One end of pusher 26 is provided with sliding means, e.g., a knob 26*a*, protruding therefrom within (as indicated by curbed dotted line in FIGS. 2,3) or above groove 24*c* to facilitate the forward and retracting movements of pusher 26. The front end surface (26*b*) of pusher 26 (adjacent head 12) is bevelled at 26*b* and the oppositely disposed end surface 20*d* of member 20 is, preferably rounded to ensure a smooth impact between pusher 26 and member 20 for upward or downward movements of the intermediate row of bristles.

In order that pusher 26 remains securely movable within groove 24*a*, one may cause the upper width portion of the latter to narrow somewhat, so that pusher 26 cannot escape outwardly, after having being pressed into a widening bottom width of the groove. (FIG. 3).

Obviously, the toothbrush may be provided with one or several fixed rows of bristles 18 alongside bristled member 20. The actual dimensions of e.g., member 20, hollow space 18, and pusher 26 are minute (compared to those illustrated in the drawing) and would not, then render the invented toothbrush more bulky or cumbersome than the conventional type brush.

The fixed and movable bristles, according to the invention, may be of identical consistency, that is hard, gentle or medium. However, it may be advantageous to have the movable single row of bristles made of firm material, as it will then retain its shape over a longer period of time.

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all modifications that may fall within the scope of the appended claims.

I claim:

1. In a toothbrush, comprising:

(a) a head, including a top surface having a slot extending into a bottomed hollow space therewithin;

(b) at least one row of first bristles embedded in and extending from the head adjacent its slotted surface;

(c) a member, a lower portion of which is movably accommodated in the hollow space of the head, its upper portion being crested by a row of second bristles and projects through and above the slot in the surface of the head alongside the first row of bristles;

(d) a handle extending from the head of the toothbrush, having a longitudinal grooved portion leading into the hollow space in the head;

(e) a pusher, accommodated longitudinally movable within the grooved portion of the handle and the hollow space in the head, capable of raising the member, and the row of second bristles crested thereon above the level of the row of first bristles, when pushed forwardly and beneath the member, respectively releasing the member, when withdrawn therefrom, for gravitation to the bottom of the hollow space in the head.

2. A toothbrush, according to claim 1, wherein at least two rows of the first bristles flank the slotted portion of the brush head.

3. A toothbrush, according to claim 1, wherein the hollow space in the head is substantially in the shape of an inverted "T".

4. A toothbrush, according to claim 3, wherein the member, accommodated in the hollow space, includes a horizontal base and a vertical stem extending upwardly therefrom, conforming spatially to the shape of the hollow space for snug upward and downward movement therein.

5. A toothbrush, according to claim 4, wherein the pusher has bevelled and the horizontal base of the member rounded end surfaces, respectively, cooperating to facilitate the raising and release of the member.

6. A toothbrush, according to claim 1, wherein the pusher is provided with sliding means to facilitate the longitudinal movements of the pusher.

7. A toothbrush, according to claim 6, wherein the pusher is provided with a knob to facilitate the longitudinal movements of the pusher.

* * * * *